US007946384B2

(12) United States Patent
Foster et al.

(10) Patent No.: US 7,946,384 B2
(45) Date of Patent: May 24, 2011

(54) ACOUSTICAL AND FIREWALL BARRIER ASSEMBLY

(75) Inventors: Matthew Foster, Lake Bluff, IL (US); Frank Schwab, Arlington Heights, IL (US)

(73) Assignee: Thermacrete L.L.C., Arlington Heights, IL (US)

( * ) Notice: Subject to any disclaimer, the term of this patent is extended or adjusted under 35 U.S.C. 154(b) by 0 days.

(21) Appl. No.: 11/986,889

(22) Filed: Nov. 27, 2007

(65) Prior Publication Data

US 2008/0184643 A1 Aug. 7, 2008

Related U.S. Application Data

(63) Continuation of application No. 11/211,161, filed on Aug. 24, 2005, now Pat. No. 7,398,856, which is a continuation-in-part of application No. 10/925,705, filed on Aug. 24, 2004, now abandoned.

(51) Int. Cl.
*E04B 1/82* (2006.01)

(52) U.S. Cl. ..... 181/290; 181/294; 52/144

(58) Field of Classification Search ..... 181/284, 181/285, 290, 294; 52/144, 145, 235
See application file for complete search history.

(56) References Cited

U.S. PATENT DOCUMENTS

| | | | | | |
|---|---|---|---|---|---|
| 1,935,574 | A | * | 11/1933 | Munroe et al. | 52/346 |
| 3,300,931 | A | | 1/1967 | Lutze | |
| 3,363,371 | A | | 1/1968 | Villalobos | |
| 3,611,653 | A | * | 10/1971 | Zinn | 52/241 |
| 3,852,931 | A | | 12/1974 | Morse et al. | |
| 3,885,362 | A | | 5/1975 | Pollock | |
| 3,913,290 | A | | 10/1975 | Billing et al. | |
| 4,185,437 | A | | 1/1980 | Robinson | |
| 4,295,691 | A | | 10/1981 | Rubenthaler | |
| 4,453,359 | A | | 6/1984 | Robinson | |
| 4,531,338 | A | | 7/1985 | Donatt | |
| 4,641,468 | A | | 2/1987 | Slater | |
| 4,674,253 | A | | 6/1987 | Young | |
| 4,702,046 | A | * | 10/1987 | Haugen et al. | 52/144 |
| 5,426,908 | A | | 6/1995 | Shayman | |
| 5,526,629 | A | | 6/1996 | Cavaness | |
| 5,661,273 | A | * | 8/1997 | Bergiadis | 181/290 |
| 5,950,277 | A | | 9/1999 | Tallmadge et al. | |
| 5,953,883 | A | | 9/1999 | Ojala | |
| 6,421,973 | B1 | * | 7/2002 | Gregg et al. | 52/481.1 |
| 6,460,301 | B1 | | 10/2002 | Mckee | |
| 2001/0010140 | A1 | | 8/2001 | Ritter et al. | |
| 2002/0092703 | A1 | | 7/2002 | Gelin et al. | |
| 2003/0070367 | A1 | * | 4/2003 | Gelin et al. | 52/144 |
| 2003/0192279 | A1 | | 10/2003 | Hughart | |
| 2005/0016104 | A1 | | 1/2005 | Seccombe | |
| 2005/0188626 | A1 | | 9/2005 | Johnson | |

* cited by examiner

*Primary Examiner* — Elvin G Enad
*Assistant Examiner* — Jeremy Luks
(74) *Attorney, Agent, or Firm* — Joseph A. Fuchs; Rockey, Depke & Lyons, LLC

(57) ABSTRACT

The present invention provides an acoustical firewall attenuating assembly. The assembly includes a first frame assembly having a first plate, a second plate and a first plurality of elongate members spaced from one another and extending between the first plate and the second plate. A structure is spaced from the first frame assembly and has an outer surface. A cement wall is positioned between the first frame and the structure and is attached to at least the first frame assembly by a first vibration dampener.

40 Claims, 3 Drawing Sheets

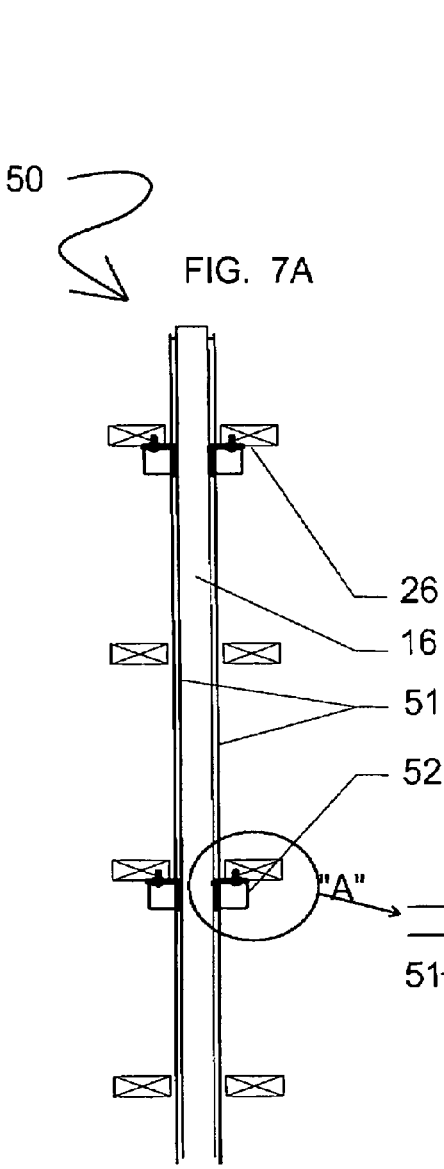
FIG. 7A
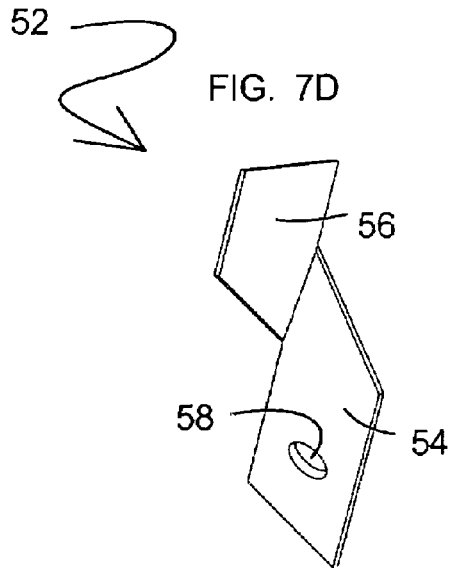
FIG. 7D
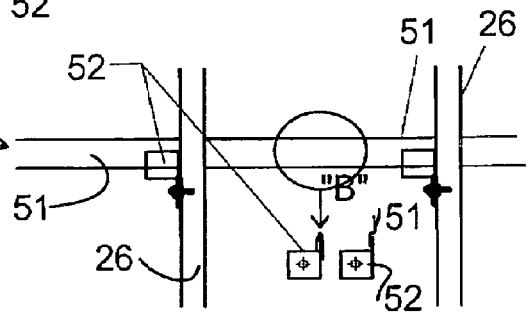
FIG. 7B
FIG. 7C

ACOUSTICAL AND FIREWALL BARRIER ASSEMBLY

CROSS-REFERENCE TO RELATED APPLICATION

The present application is a continuation of U.S. application Ser. No. 11/211,161, filed Aug. 24, 2005 now U.S. Pat. No. 7,398,856, which is a continuation-in-part of U.S. application Ser. No. 10/925,705, filed Aug. 24, 2004 now abandoned each of which are incorporated herein in their entirety by reference and made a part hereof.

FEDERALLY SPONSORED RESEARCH OR DEVELOPMENT

Not Applicable.

BACKGROUND OF THE INVENTION

1. Technical Field

The present invention pertains to acoustical and firewall barrier assemblies particularly suitable for frame construction.

2. Background

Stud wall construction of walls and other structures is in widespread use in the United States. Typically, stud wall construction has wood or metal studs. Wood framing includes, for example, a series of 2 by 4 wood studs, generally 1½ by 3½ inches in cross-sectional size. The studs extend vertically between, and are secured to, a lower stud plate on the floor and double upper stud plates at the ceiling. In metal stud construction, the studs are made of sheet metal having a generally C-shaped cross-section.

In conventional stud wall construction the walls are finished by securing to the studs gypsum board, plywood, plaster or the like (called "wall board" for convenience); and sometimes insulation of various types is installed between the studs and the wall boards. Such stud wall construction provides little barrier to fire or sound transfer.

SUMMARY OF THE INVENTION

The present invention provides an acoustical firewall attenuating assembly. The assembly includes a first frame assembly having a first plate, a second plate and a first plurality of elongate members spaced from one another and extending between the first plate and the second plate. A structure is spaced from the first frame assembly and has an outer surface. An acoustical barrier element is positioned between the first frame and the structure and is attached to at least the first frame assembly by a first vibration dampener.

The present invention further provides a method for fabricating an acoustical firewall assembly. The steps include: (1) providing an acoustical barrier element, (2) inserting the acoustical barrier element between a first frame structure and a second structure, and (3) attaching the acoustical barrier element to the first frame structure with a vibration dampener.

The present invention also provides an anchor for attaching a cement wall to a structure.

These and other aspects and attributes of the present invention will be discussed with reference to the following drawings and accompanying specification.

BRIEF DESCRIPTION OF THE DRAWINGS

FIG. 7*a* is a top view of an assembly of acoustical barrier elements that can be moved simultaneously.

FIG. 7*b* is a side elevational view of the assembly of FIG. 7*a*.

FIG. 7*c* is an enlarged view of a clip and a bar portions of the assembly of FIGS. 7*a,b*.

FIG. 7*d* is a perspective view of a clip of FIGS. 7*a-c*.

DETAILED DESCRIPTION OF THE INVENTION

The present invention is susceptible to embodiments in many different forms. Preferred embodiments of the invention are disclosed with the understanding that the present disclosure is to be considered as exemplifications of the principles of the invention and are not intended to limit the broad aspects of the invention to the embodiments illustrated.

Figure 1:
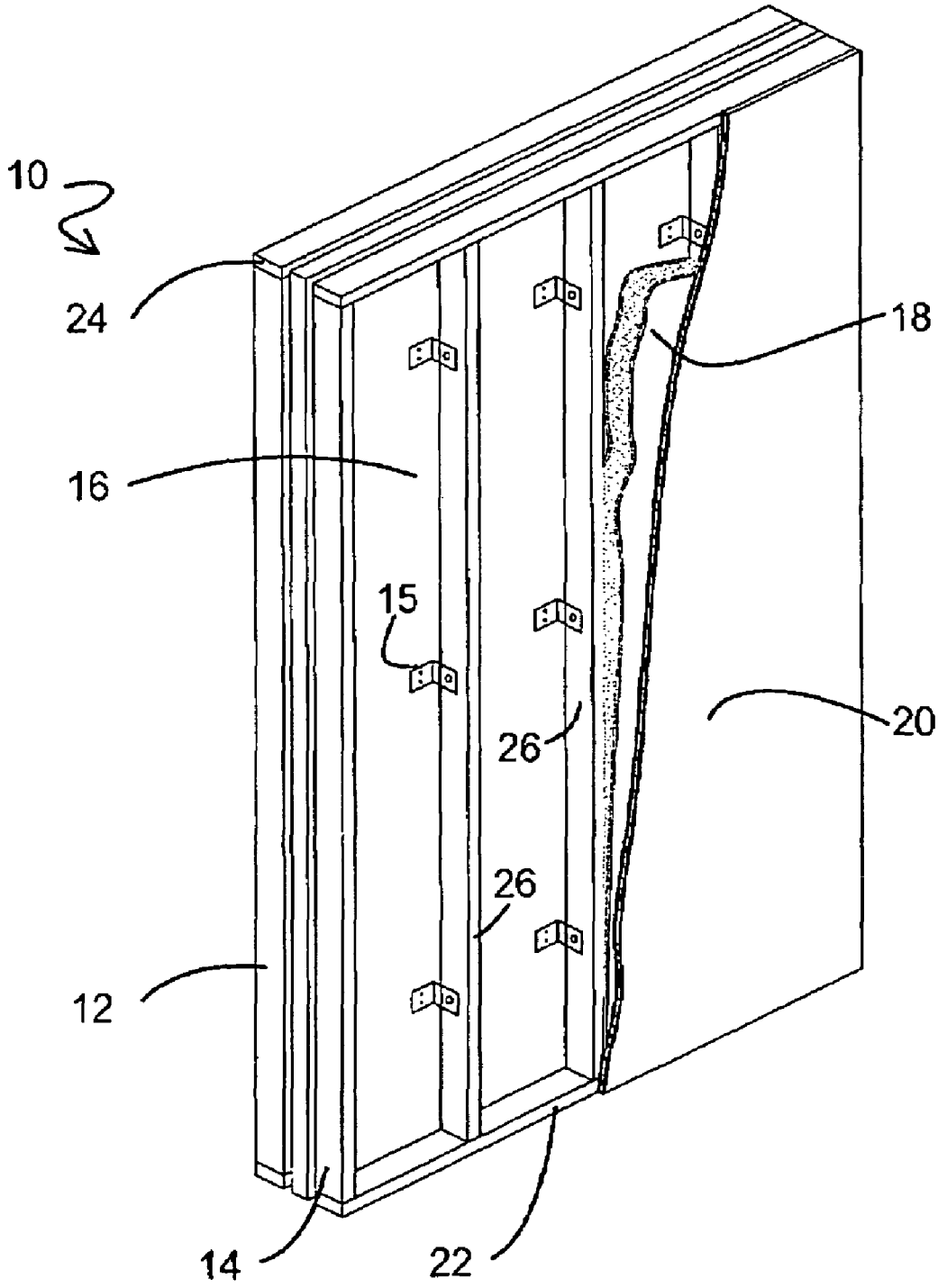
FIG. 1 is a perspective view partially broken away of an acoustical firewall barrier assembly.

FIG. 1 shows an acoustical firewall barrier assembly 10 having a first structure 12 spaced from a second structure 14, an acoustical barrier element 16 positioned between the first and second structures 12 and 14 and spaced a distance from both, a plurality of vertically spaced vibration dampeners 15 connecting the acoustical barrier element 16 to the first structure, optional insulating material 18 and optional wall board material 20.

The first and/or the second structure can be a planar structure such as a wall or floor or the like. It is contemplated these structures could be made from wood, concrete, metal, fabric, plastic, gypsum, plaster, paperboard or the like. It is also contemplated the first structure can be a frame structure and the second structure can be a planar structure. In a preferred form of the invention, the first structure and the second structure are of a conventional stud wall frame construction including a base stud plate 22, and an upper stud plate 24. The base stud plate 22 is typically secured to a floor and the top stud plate is secured to a ceiling. The upper stud plate 24 can include two stud plates stacked on top of one another, although only a single top stud plate is shown. A plurality of studs 26 extend vertically between, and are secured at their ends to, the floor stud plate 22 and the ceiling stud plate 24.

FIG. 1 shows the floor stud plate, the ceiling stud plate, and the vertically extending studs are made of wood; these members usually are 1½ by 3½ inches in cross-sectional size in the U.S. The studs 26 are spaced 16 inches on center according to standard U.S. practice. Such stud wall frame is of conventional type and the construction thereof will be apparent to those skilled in the art from the description herein. It is contemplated replacing the components of the wooden stud frame with components made from metal, plastic, or a composite material.

The acoustical barrier element 16 is fabricated from materials capable of dampening a sound wave and include cement or cement-like material, concrete or concrete-like material, limestone or limestone-like material, gypsum, metal, wood, fabric, paperboard, glass mat board, fiberglass, polymers, cellulosic materials, composite materials, carbon fiber reinforced concrete or other similar material. These materials can be used in combination such as by the mechanical blending of materials say concrete and gypsum for example. The materials can also be combined by forming layered structures such as an element of concrete connected to an element of gypsum.

In one preferred form of the invention the acoustical barrier element 16 is fabricated from concrete and more preferablyautoclave aerated concrete (AAC). AAC is lightweight compared to normal concrete. For example, typical AAC weighs one-fourth to one-fifth the weight of normal concrete, which weighs in the range 130 to 145 lbs/ft. AAC has extreme thermal properties. It displays no spalling of material when exposed to temperatures at or approaching 2000 degrees Fahrenheit. AAC is an inorganic material resistant to weather decay and pest attack. AAC also provides significant acoustical barrier properties. Suitable AAC materials are sold by THERMACRETE the assignee of the present invention.

AAC is typically formed as a blend of sand or fly ash, lime, Portland cement, water, and an expansion agent of aluminum powder or paste. The mixture is usually cast into large molds and allowed to expand to a volume greater than the original semi-fluid mass. The expanded mass is sliced to desired dimensions and shapes into the structural elements mentioned above. The processed elements are then placed into large pressurized chambers called autoclaves to complete the curing or hardening of the finished product. The structural elements are typically cured for 8-12 hours at 12-13 atmospheric pressures at 360-385 degrees Fahrenheit.

In another preferred form of the invention the acoustical barrier element 16 is fabricated from aerated concrete which is also produced in structural elements such as panels and blocks. However, aerated concrete product is allowed to air cure in normal single atmospheric pressures and ambient temperatures. The process for achieving maximum strength takes longer. Typical curing time for aerated concrete is 7-28 days versus 20-24 hours for autoclaved aerated concrete. Aerated concrete is sold under the trade names FLEX-CRETE, PEARLITE, DURROCK and HARDIE BOARD.

Figure 6:
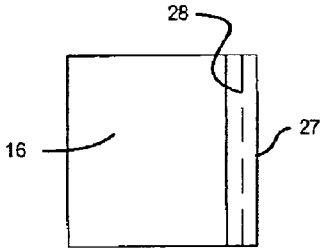
FIG. 6 is a top plan view of an acoustical barrier element with a strip of intumescent material attached along a peripheral edge of the barrier element.

In one preferred form of the invention shown in FIG. 6, the acoustical barrier element 16 will have an intumescent material 27 attached to a portion of the barrier material and more preferably to a peripheral portion 28 thereof to extend between other acoustical barrier elements or other structures. What is meant by intumescent is the material with swell or char when exposed to flame. Suitable intumescent materials include metal foils, fire-resistant fabrics, aluminum foil, stainless steel foil, fiberglass, alumina silica fabric and other intumescent materials well known to those skilled in the art. These intumescent materials can be used alone or in combination by blending or forming layer structures of the same. Intumescent adhesives can be used to hold, adhere or bind the intumescent materials together including 3M's CP-25 intumescent caulking material that can be obtained from 3M Fire Protection Products, St. Paul, Minn., or a FX-100 coating material available from Flame Seal Products, Inc. Houston, Tex. The intumescent material is available for purchase in many forms including strips of material such as those sold by AstroFlame® as intumescent fire seals.

FIG. 6 shows one preferred form of the invention an acoustical barrier element will have a board of cement 16 or concrete like material or aerated concrete or AAC material or other material mentioned above with a strip 27 of intumescent material attached to a peripheral edge 28 of the board. In a preferred form of the invention, a portion of the strip extending beyond an edge of the board has an adhesive strip covered with a strip of peel stock along an outward edge of the strip. To install the board 16 it is placed in position and the peel stock is removed and the adhesive strip is adhered to an adjacent structure.

Suitable gypsum material includes drywall materials. Suitable wood material includes any type of wood product but typically takes the form of plywood, OSB, MDF, melamine, particle board, press board. Suitable plastic material includes both thermoplastic and thermosetting materials and can take the form of rigid, semi-rigid or flexible sheets or can be a foamed material. The plastic materials can be derived from polymers, copolymers and terpolymers derived from chemical groups including olefins, amides, amines, ethers, urethanes, esters, styrene, acrylonitrile, sulfones, vinyl chlorides, vinyl alcohols, epoxys, acrylates, substituted acyrlates, methacrylates, ethacrylates, vinyl esters and the like.

Figure 2:
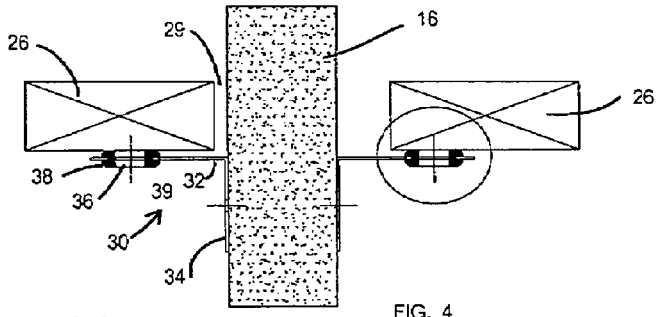
FIG. 2 is a top view of a portion of an acoustical firewall barrier assembly.

The autoclave aereated concrete and the aerated concrete are available as wall board panels and blocksin numerous shapes and sizes. The wall board panels are typically elongate having a length dimension substantially greater than the width dimension. Panel sizes include lengths of from 4 to 20 feet, widths of two to 8 feet and thicknesses of from 1 to 8 inches. The advantage of such elongate wall boards is that they may be easily formed into a wall when compared to building walls by stacking cement blocks. The concrete wall board should be spaced from the first frame and the second frame by a distance 29 (FIGS. 2 and 5) to assist in isolating the cement board from the frames for the purposes of isolating vibrations in one structure from the other.

The distance 29 between the wall 16 and the first structure and the distance between the wall 16 and the second structure can be of substantially the same dimension to form a symmetrical structure, or, in a more preferred form of the invention, the distances will be different to define an asymmetrical structure. The difference in the distances will typically be 3 inches or less and more preferably will be 1½ inches or less.

Figure 3:
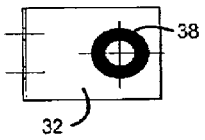
FIG. 3 is an end view of an anchor and vibration dampener.

In one preferred form of the invention, the vibration dampeners 15 are shown to be positioned, one each, on a generally L-shaped anchor 30 or bracket. The anchor 30 has a first face 32 and a second face 34 extending in directions transverse to one another, and, in a preferred form of the invention, the first face 30 extends in a direction substantially perpendicular to the second face 32. FIG. 3 shows a portion of the first face 32 is removed to define a through-hole 36. The hole 36 is generally centrally disposed on the first face 30. A grommet 38 is inserted into the through-hole 36 and has a portion or portions 39 extending away from the first face 32. The grommet 38 is effective to dampen vibrations in the first structure 12 so they are not transmitted through the wall assembly 10 or they are substantially diminished.

Figure 5:
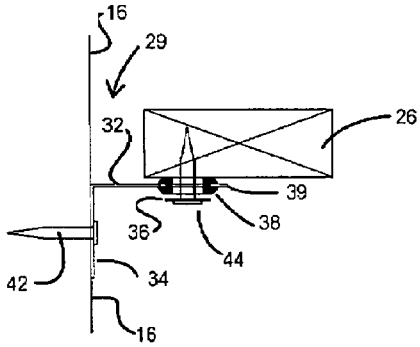
FIG. 5 is a top view of a portion of an acoustical firewall barrier assembly.
Figure 4:
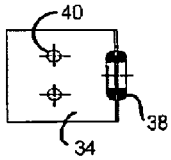
FIG. 4 is another end view of an anchor and vibration dampener.

FIGS. 4 and 5 show that the second face 34 also has one or more holes 40 to accommodate a fastener 42 such as nails or screws for attaching the second face 34 to the cement board 16. Similarly, a fastener and washer combination 44 is used to attach the first face 32 to a stud 26.

The anchor 30 can be made from any suitable material including metal, polymer, wood or a composite material. In a preferred form of the invention, the anchor will be fabricated from a material that fails at temperatures of approximately 800° F.-1600° F. and more preferably in excess of 1000° F. What is meant by the term "fail" is the anchor melts or degrades to the point where it can no longer effectively serve as an anchor. Suitable metals include aluminum, aluminum alloys, and those metals having a melting point temperature within the limits set forth above. Suitable polymers include those high temperature resistant polymers and can be a thermoplastic-type polymer or thermosetting-type polymer. Suitable polymers include, but are not limited to, polyimides, poly(ethersulfones), poly(phenylene sulfides), poly(phenylene oxide), polyketones, engineering thermoplastics or other temperature resistant polymers.

The vibration dampener can be made from polymers, natural rubber, and synthetic rubbers. The vibration dampener can take on many forms including objects or assemblies having a body capable of dampening a vibration. The object can dampen the vibration by virtue of a material property of elasticity. The object can also have a spring or like device for dampening vibrations. In one preferred form of the invention, the vibration dampener is a grommet made from neoprene. The vibration dampening material could also be applied to a portion of the first face 32 or to both the first face 32 and the second face 34 by other techniques such as applying the vibration dampening material to a portion of the faces or over essentially the entire surface of the first face or the second face or on both the first face and the second face 32, 34 to define a layer of dampening material extending away from the faces. The vibration dampener can take on other forms than a grommet and do not necessarily have to be associated with an anchor or bracket.

Suitable polymers to provide vibration dampening have elastomeric properties and can be a polyolefin, EVA, styrene and hydrocarbon copolymers, styrene and hydrocarbon block copolymers, polyamides, polyesters, polyethers and the like.

It is also contemplated the vibration dampeners 15 can take on other forms. Bonded washers, screws, nails, nuts and bolts where the fasteners have a rubber or elastomeric coating to absorb vibrations. It is contemplated the fasteners can be used with the L-shaped bracket or without or used in combination with another type of bracket such as a flat bracket or a T-shaped bracket or the like.

The optional insulating material can be provided to enhance the thermal and acoustical insulation properties and can be fiberglass, foamed polystyrene, HDPE type insulation or other type of insulation that is commonly available.

The wall board 20 material can be planar material to attach an outer surface of the first structure or the second structure or both. The wall board material can be sheet rock, drywall, plaster, particle board, plywood, tile, cardboard, plastic sheeting or the like.

The acoustical wall barrier assembly 10 should have high acoustical barrier characteristics. In a preferred form of the invention, the assembly 10 will have a sound transfer coefficient (STC) of about 50 or higher and more preferably will be from about 50 to about 65. It is also desirable for the acoustical barrier to enhance the fire rating for the wall barrier assembly 10. In a preferred form of the invention, the fire rating will be 2 hours or greater and preferably from 2 to 4 hours.

The acoustical wall barrier assembly 10 can be easily assembled or retrofitted to existing structures. The method includes the steps of: inserting the acoustical element 16 between the first structure and the second structure; and attaching the cement wall 16 to the first structure with one or more vibration dampeners.

The step of inserting the cement wall, in a preferred form, includes the step of building a wall from cement blocks or cement boards as described herein. In a most preferred form of the invention the step of inserting a cement wall includes the step of inserting a cement board between the first frame structure and the second structure by sliding a cement board between the first and second structures and then attaching the cement board to an outer portion of one or more studs using a plurality of sound dampeners spaced along the length of the stud or studs. Cement boards made from AAC are typically light enough for one or more persons to accomplish this step by hand. It is also possible to utilize a crane to assist in guiding a cement board between the first and second structures.

FIG. 1 shows three vertically extending acoustical elements the form of boards, and even more preferably cement boards or gypsum boards, that extend the full length of the studs and extends from the bottom plate to the top plate. It is contemplated the acoustical elements can extend only a portion of the length of a stud provided that the overall sound dampening is not significantly impacted. In a preferred form of the invention, a thin bed of mortar, intumescent material or other suitable material, is applied to a seam formed between two abutting lateral edges of two adjacent acoustical elements.

Additional steps of inserting the optional insulation and applying wall board to an outer surface of the first frame and the second frame (if necessary) completes the acoustical firewall barrier structure.

In the event of a fully engaged fire, the anchors are designed to fail so that the wall board can fall away from the acoustical elements and not pull them with it. This helps maintain the acoustical firewall barrier 10 substantially intact for 2 to 4 hours in a fire.

FIGS. 7*a-c* show an acoustical barrier assembly 50 having numerous boards 16 of AAC or other cement-like material as described herein and a transversely extending bar 51 fixedly attached to the boards. The bar allows for moving and placing one or more acoustical barrier elements simultaneously. In a preferred form of the invention, the bar will have a surface for removably engaging a series of spaced members 52 that are fixedly attached to the metal or wooden studs 26. In a preferred form of the invention, the bar 51 has a generally U-shaped or Z-shaped cross-sectional shape for engaging a portion of the members 52.

FIG. 7*d* shows the members 52, in a preferred form have a first flange 54 for attaching to the studs 26 and a second flange 56 for engaging a surface of the bar 51. The first flange 54 extends in a first plane and the second flange 56 extends in a second plane and the first plane is transverse to the second plane and more preferably perpendicular to the second plane.

The engagement between the second flange 56 and the bar 51, in a preferred form of the invention, is a slip connection, that is, the bar 51 and the second flange 56 are not otherwise mechanically fastened to one another. The second flange 56 has a through-hole 58 which can accommodate an optional grommet as disclosed herein. Because there is no mechanical fastening between the member 52 and the bar 51 the member 52 will drop from away from the bar 51 in the event of a fire and allow for the frame structure to fall away from the barrier assembly 50 and the boards 16 leaving the barrier assembly standing to act as a barrier to the spread of the fire.

While specific embodiments have been illustrated and described, numerous modifications come to mind without departing from the spirit of the invention and the scope of protection is only limited by the scope of the accompanying claims.

What is claimed is:

1. An acoustical attenuating firewall assembly comprising:

a first frame assembly having a first plate extending in a first direction and having a top surface, a second plate having a bottom surface spaced from the top surface and in registration therewith and a first plurality of elongate members spaced from one another and extending in a second direction transverse to the first direction and each elongate member having opposed ends, the elongate members extending between the top surface and the bottom surface with one end of each elongate member being attached to the first plate and the opposite end being attached to the second plate; and a preformed cement wall having a continuous outer planar surface extending along the second direction and being spaced from the first frame and attached to at least one of the elongate members with a vibration dampener to attach the preformed cement wall to the first frame to define the assembly, the vibration dampener being positioned on an anchor having a first face connected to the first frame and a second face connected to the wall and is fabricated from a material selected from polymers, natural rubbers and synthetic rubbers.

2. The assembly of claim 1, wherein the assembly has a sound transfer coefficient of greater than 50.

3. The assembly of claim 1, wherein the assembly has a sound transfer coefficient of from about 50 to about 65.

4. The assembly of claim 1, wherein the first face is transverse to the second face.

5. The assembly of claim 4, wherein the first face is substantially perpendicular to the second face.

6. The assembly of claim 1, wherein the anchor is substantially L shaped.

7. The assembly of claim 1, wherein the vibration dampener is attached to the anchor and extends away a distance therefrom.

8. The assembly of claim 7, wherein the vibration dampener is attached to a first face of the anchor.

9. The assembly of claim 8, wherein the vibration dampener is essentially centrally disposed on the first face.

10. The assembly of claim 9, wherein the first face has a portion removed to define a hole therethrough and the vibration dampener is positioned within the hole.

11. The assembly of claim 10, wherein the dampener is a grommet inserted through the hole.

12. The assembly of claim 1, wherein the anchor is fabricated from aluminum.

13. The assembly of claim 1, wherein the cement wall is fabricated from autoclave aerated concrete.

14. An acoustical firewall attenuating assembly comprising:

a first frame assembly having a first plate extending in a first direction and having a top surface, a second plate having a bottom surface spaced from the top surface and in registration therewith and a first plurality of elongate members spaced from one another and extending in a second direction transverse to the first direction and each elongate member having opposed ends, the elongate members extending between the top surface and the bottom surface with one end of each elongate member being attached to the first plate and the opposite end being attached to the second plate;

a structure spaced from the first frame assembly and having an outer surface; and a preformed cement wall positioned between the first frame and the structure and having one planar surface extending along the second direction and being attached to at least one of the elongate members and spaced therefrom with a first vibration dampener and having an opposed planar surface of the preformed cement wall attached to the structure and spaced therefrom by a second vibration dampener to define the assembly.

15. The assembly of claim 14, wherein the vibration dampener is fabricated from a material selected from the group consisting of polymers, natural rubbers, and synthetic rubbers.

16. The assembly of claim 15 wherein the vibration dampener is positioned on an anchor.

17. The assembly of claim 16, wherein the anchor has a first face for connecting to the first frame and a second face for connecting to the wall.

18. The assembly of claim 17, wherein the anchor is substantially L shaped.

19. The assembly of claim 18, wherein the vibration dampener is attached to the anchor and extends away a distance therefrom.

20. The assembly of claim 14, wherein the elongate members are studs.

21. The assembly of claim 20, wherein the studs are fabricated from a material selected from the group consisting of wood, metal, polymer, and composite material.

22. The assembly of claim 16, wherein the anchor fails at a temperature in excess of 1000° F.

23. The assembly of claim 22, wherein the anchor is fabricated from aluminum.

24. The assembly of claim 14, wherein the assembly has a sound transfer coefficient of greater than 50.

25. The assembly of claim 14, wherein the assembly has a sound transfer coefficient of from about 50 to about 65.

26. The assembly of claim 14, wherein the cement wall is fabricated from autoclave aerated concrete.

27. The assembly of claim 14 wherein the first frame assembly is spaced from the cement wall by a first distance and the structure is spaced from the cement wall by a second distance wherein the first distance is different from the second distance.

28. The assembly of claim 14 wherein the first frame assembly is spaced from the cement wall by a first distance and the structure is spaced from the cement wall by a second distance wherein the first distance is essentially equal to the second distance.

29. A method for fabricating an acoustical firewall assembly comprising:

providing a preformed cement element having opposed planar surfaces;

providing a first frame assembly having a first plate extending in a first direction and having a first top surface, a second plate having a first bottom surface spaced from the first top surface and in registration therewith and a first plurality of elongate members spaced from one another and extending in a second direction transverse to the first direction and each elongate member of the plurality of elongate members having opposed ends, the plurality of elongate members extending between the first top surface and the first bottom surface with one end of each elongate member being attached to the first plate and the opposite end being attached to the second plate;

providing a second frame assembly spaced from the first frame assembly to define a gap, the second frame assembly having a third plate extending in the first direction and having a second top surface and a fourth plate having a second bottom surface spaced from the second top surface and in registration therewith and a second plurality of elongate members spaced from one another and extending in the second direction and each elongate member of the second plurality of elongate members having opposed ends, the second plurality of elongate members extending between the second top surface and the second bottom surface with one end of each elongate member being attached to the third plate and the opposite end being attached to the fourth plate;

inserting the cement element in the gap;

attaching one planar surface of the cement element to the first frame structure with a vibration dampener; and attaching the opposed planar surface of the cement element to the second frame structure with a vibration dampener.

30. The method of claim 29, wherein the cement element is a cement board or a cement block.

31. The method of claim 29, wherein the vibration dampener is fabricated from a material selected from the group consisting of polymers, natural rubbers, and synthetic rubbers.

32. The method of claim 31, wherein the vibration dampener is positioned on an anchor.

33. The method of claim 32, wherein the anchor is substantially L shaped.

34. The method of claim 33, wherein the vibration dampener is attached to the anchor and extends away a distance therefrom.

35. The method of claim 34, wherein the dampener is a grommet attached to the anchor.

36. The method of claim 35, wherein the anchor is fabricated from aluminum.

37. The method of claim 29, wherein the assembly has a sound transfer coefficient of greater than 50.

38. The method of claim 29, wherein the assembly has a sound transfer coefficient of from about 50 to about 65.

39. The method of claim 29, wherein the step of attaching the board to the first frame structure with a vibration dampener comprises providing a plurality of vibration dampeners and attaching the dampeners along the board and the frame at spaced locations.

40. The method of claim 29 wherein the cement element has a peripheral edge and further comprises an intumescent material extending from a peripheral edge.

* * * * *